US006272682B1

(12) United States Patent
Fullum

(10) Patent No.: US 6,272,682 B1
(45) Date of Patent: Aug. 14, 2001

(54) EXTENSIBLE LEG PAD

(75) Inventor: Jean-François Fullum, Montreal (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/642,270

(22) Filed: Aug. 18, 2000

(30) Foreign Application Priority Data

Aug. 26, 1999 (CA) ..... 2281470

(51) Int. Cl.[7] ..... A41D 13/00
(52) U.S. Cl. ..... 2/22; 2/911; 128/882
(58) Field of Search ..... 2/16, 455, 22, 2/24, 911; 128/878, 881, 882; 602/23, 26, 62; 24/16 PB, 580, 585, 583, 584, 586

(56) References Cited

U.S. PATENT DOCUMENTS 2,982,968 * 5/1961 Groot ..... 2/22
4,627,108 * 12/1986 Jarvinen ..... 2/22
4,692,946 * 9/1987 Jurga ..... 2/22
5,477,559 * 12/1995 Clement ..... 2/22
5,652,956 * 8/1997 Hoshizaki et al. ..... 2/22
5,715,535 * 2/1998 Hamilton et al. ..... 2/59
5,732,411 * 3/1998 Coleman et al. ..... 2/22
5,898,939 * 5/1999 Schramm ..... 2/22
6,047,448 * 4/2000 Arnold ..... 24/16 PB

FOREIGN PATENT DOCUMENTS 647906 9/1962 (CA) .

* cited by examiner

*Primary Examiner*—John J. Calvert
*Assistant Examiner*—Tejash Patel
(74) *Attorney, Agent, or Firm*—Ratner & Prestia

(57) ABSTRACT

An extensible leg pad including an upper portion and a lower portion. The upper portion comprises a rigid knee shield and a first rigid shin, and the lower portion comprises a second rigid shin shield. These shields comprise overlapping surfaces that allow adjustment of the overall length of the pad. The pad also comprises a belt which secures together the upper and lower portions and which is responsive to tension for pressing the overlapping surfaces together at a contacting area.

58 Claims, 6 Drawing Sheets

EXTENSIBLE LEG PAD

FIELD OF THE INVENTION

The invention relates to an extensible leg pad for use as protective gear in contact sports, especially hockey.

BACKGROUND OF THE INVENTION

Hockey leg protectors conventionally have a flexible elongated padding liner positionable around the front of user's leg from the ankle to above the knee (note that common terms such as "shin guards" or "shin pads" are therefore slightly misleading since protection for the knee is also provided). Rigid or semi-rigid shield members such as rigid plastic knee shield and rigid plastic shin shield are sewn or riveted to the padding liner. The knee shield moves with the knee when the user flexes his leg simply by the flexibility of the padding liner. Usually, the length of the leg pad is fixed, but some prior pads allowed adjustments in length.

U.S. Pat. No. 5,732,411 discloses a protective pad having two adjustable portions which may be secured together at varying relative positions in order to adjust the pad length. More particularly, the pad includes an upper sliding section and a lower sliding section which comprises a mateable portion. The upper sliding section comprises a knee protector and a base portion which comprises a mateable portion including openings. The base portion has an opening which is similar in size and configuration to the openings of the mateable portion. These openings can be brought into registry with the opening of the base portion and an element can then be inserted for locking the two sliding sections in place.

U.S. Pat. No. 5,652,956 discloses an adjustable shin pad having a lower portion slidable with respect to an upper portion by virtue of one or more slotted holes in either or both of the upper portion and/or lower portion. Bolts and T-nuts are used in the slots to secure the upper and lower portions together.

Canadian Patent No. 647,906 discloses a leg pad comprising a knee guard, a shin guard and an instep guard with flexible portions. The flexible portion located between the knee and shin guards comprises additional sets of eyelets which may be aligned with the corresponding opening in the shin guard. Thus, to make the leg guard shorter or longer, different eyelets may be aligned with the openings for securing the flexible portion to the shin guard.

While these prior pads provide length adjustments, they require use of bolts, screws, nuts or another element for adjusting the length of the pad and for securing together the two adjustable sections of the pad through registry of slots or openings.

Thus, there is a need in the industry for a pad which provides an easier way to adjust and secure together the different adjustable portions of the pad.

It is an object of the present invention to provide an extensible leg pad including an upper portion comprising a knee shield for covering a substantial part of a front surface of user's knee and a first shin shield along and partially around user's shin, said knee shield and said first shin shield being secured to an upper padding liner positionable over the knee and along and partially around the shin, a lower portion comprising a second shin shield along and partially around the shin which is secured to a lower padding liner positionable along and partially around the shin, said first and second shields having respective first and second overlapping surfaces, and a belt for securing together said upper and lower portions wherein said upper and lower portions allow adjustment of the overall length of said pad, and said belt is responsive to tension for pressing said overlapping surfaces together at a contacting area.

It is a further object of the present invention to provide an extensible leg pad including an upper portion comprising a knee shield for covering a substantial part of a front surface of user's knee and a first shin shield along and partially around user's shin, a lower portion comprising a second shin shield along and partially around the shin, said first and second shields having respective first and second overlapping surfaces, and a belt for securing together said upper and lower portions wherein said upper and lower portions allow adjustment of the overall length of said pads and said belt is responsive to tension for pressing said overlapping surfaces together at a contacting area.

It is a further object of the present invention to provide an extensible leg pad including an upper portion comprising a knee shield for covering a substantial part of a front surface of user's knee, a lower portion comprising a shin shield along and partially around a user's shin, said knee and shin shields having respective first and second overlapping surfaces, and a belt for securing together said upper and lower portions wherein said upper and lower portions allow adjustment of the overall length of said pad, and said belt is responsive to tension for pressing said overlapping surfaces together at a contacting area.

In a preferred embodiment of the present invention, the first shin shield of the upper portion and the second shin shield of the lower portion comprise overlapping surfaces having a portion made of rubber, and such a pad further includes a belt having a strap with loops and hooks sections for securing together the upper and lower portions at the contacting area.

In another embodiment of the present invention, the first shin shield of the upper portion and the second shin shield of the lower portion comprise overlapping surfaces having a portion that includes toothed section capable of interlocking together with positive engagement these sections, such a pad further includes a belt having a strap with loops and hooks sections for securing together the upper and lower portions at the contacting area.

Other objects and features of the invention will become apparent by reference to the following specification and to the drawings.

BRIEF DESCRIPTION OF THE DRAWINGS

A detailed description of the preferred embodiment of the invention is provided herein with reference to the following drawings, wherein.

Figure 1:
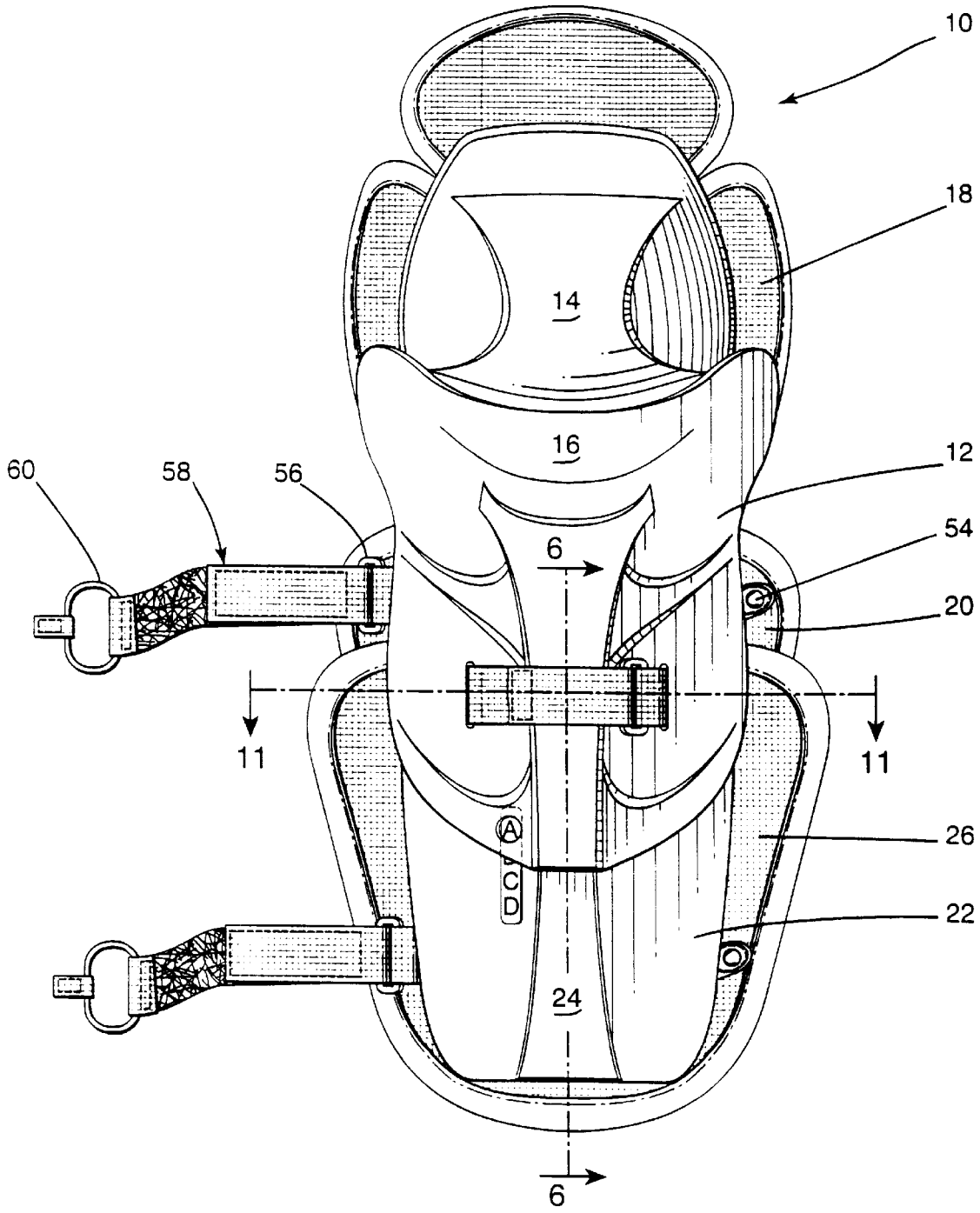
FIG. 1 is a front elevational view of an adjustable pad constructed in accordance with the invention.

In the drawings, the preferred embodiment of the invention is illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

Figure 2:
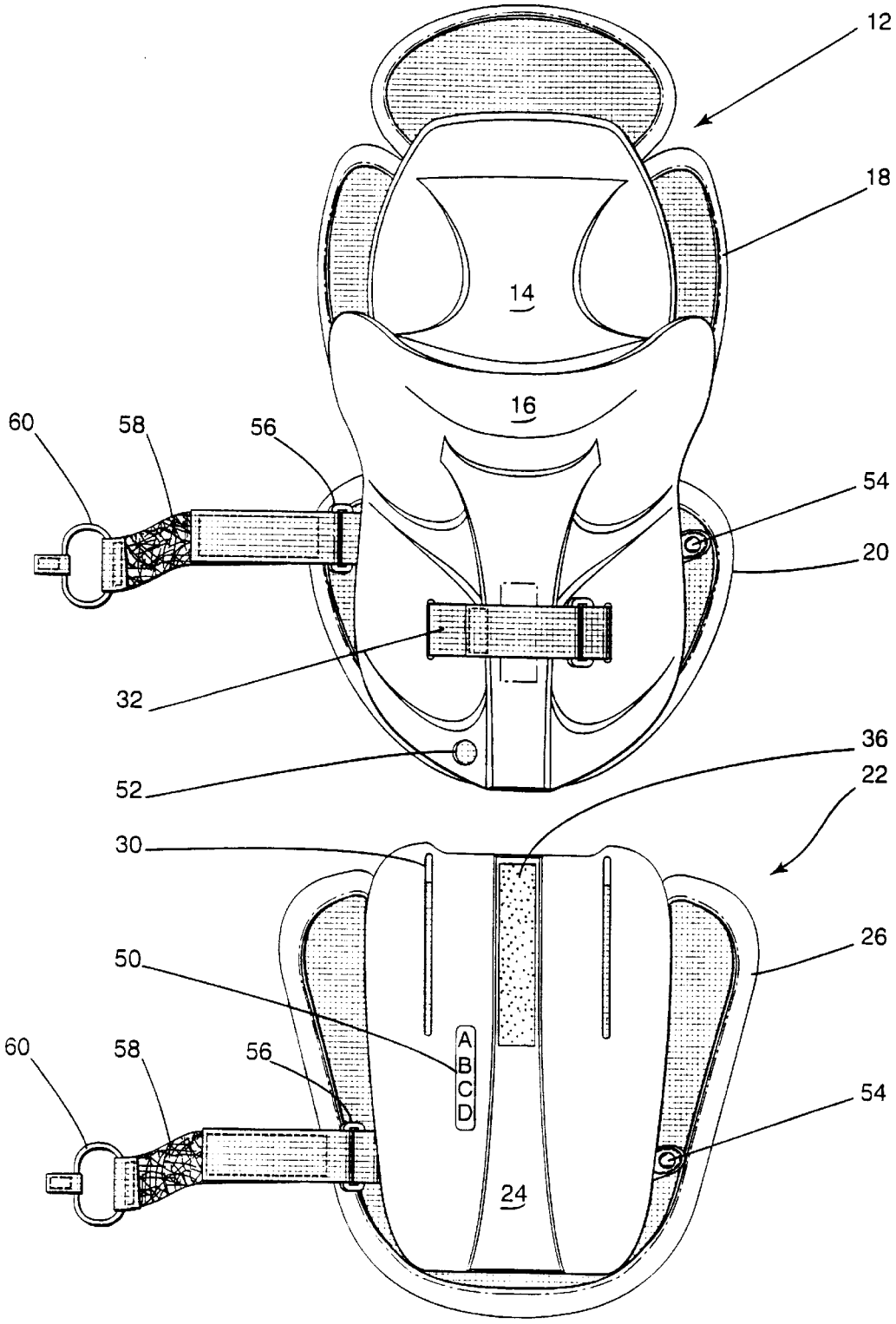
FIG. 2 is a front view of the pad illustrated in FIG. 1 in which the pad is shown in two portions.
Figure 3:
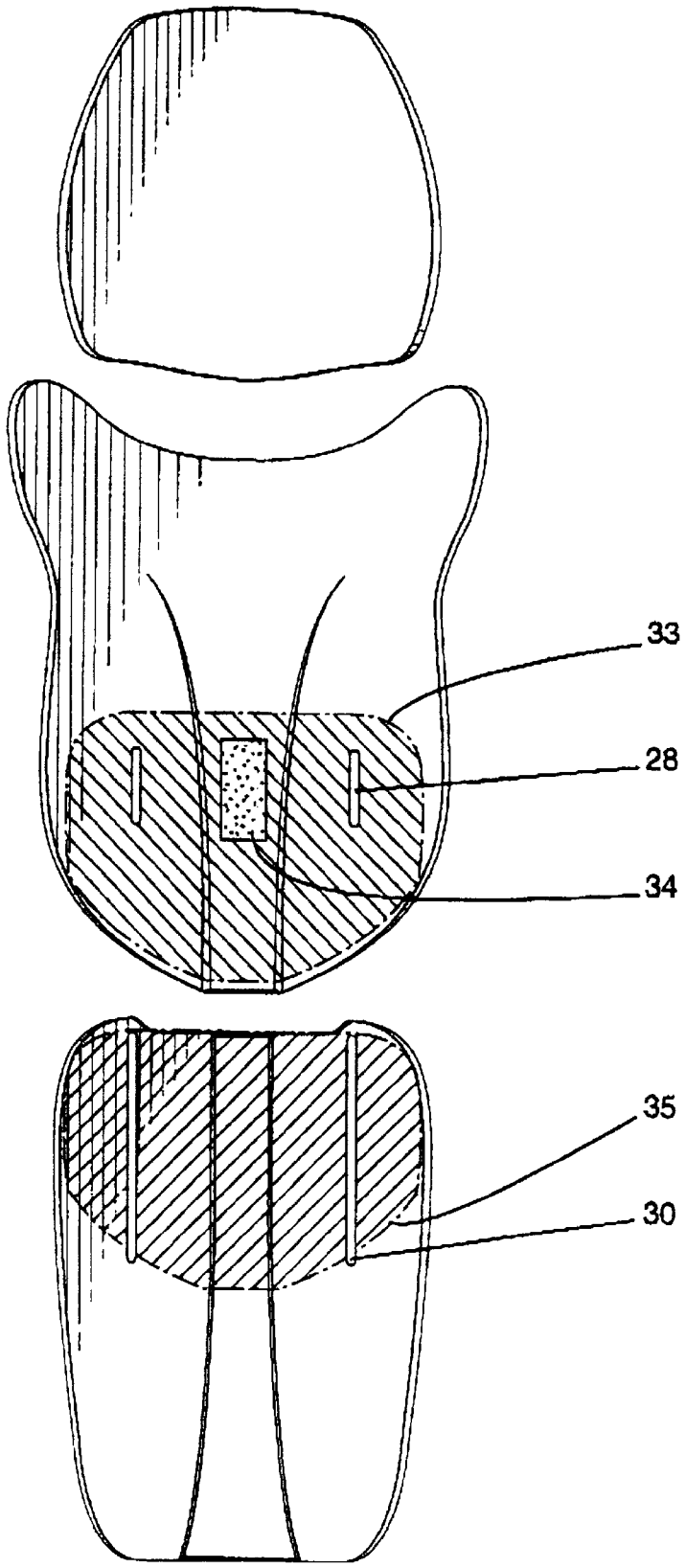
FIG. 3 is a rear view only showing knee shield and shin shields of the pad illustrated in FIG. 1.

FIGS. 1 to 3 illustrate an extensible leg pad constructed in accordance with the present invention which is generally designated by the reference numeral 10. The pad 10 includes an upper portion 12 comprising a rigid knee shield 14 for covering a substantial part of a front surface of user's knee and a first rigid shin shield 16 along and partially around user's shin. The knee shield 14, is secured to a knee padding liner 18 which partially wraps the knee and the shin. The first rigid shin shield 16 is secured to a first shin padding liner 20 which partially wraps the shin.

The pad 10 further includes a lower portion 22 comprising a second rigid shin shield 24 along and partially around the shin. The second rigid shin shield 24 is secured to a second shin padding liner 26 which partially wraps the shin. The first and second shin padding liners 20 and 26 are designed in order that an upper portion of the second shin padding liner 26 overlaps a lower portion of the first shin padding liner 20 when the upper and lower portions 12 and 22 are secured together.

Figure 4:
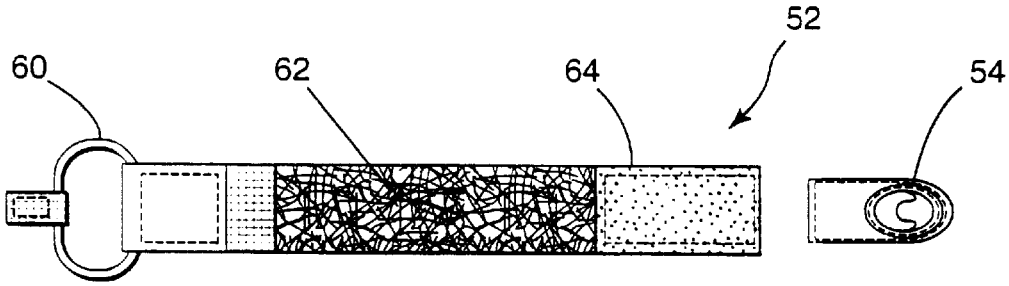
FIG. 4 is an enlarged front view of a strap assembly of the pad illustrated in FIG. 1.
Figure 5:
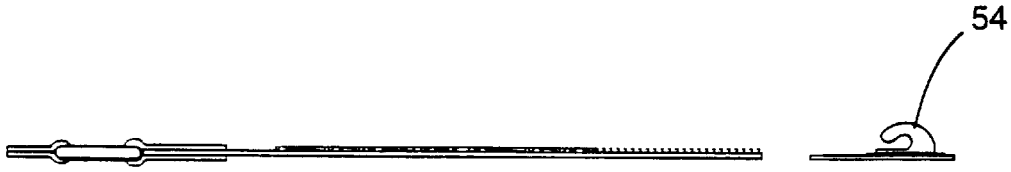
FIG. 5 is an enlarged side view of the strap illustrated in FIG. 4.

The pad 10 also includes a strap assembly 52. The strap assembly 52 comprises a hook 54 secured on one side of the pad 10, a ring 56 secured on the other side of the pad 10 and an adjustable strap 58. As best seen on FIGS. 4 and 5, the adjustable strap 58 has a loop 60 at one end and loops and hooks sections 62 and 64. In use, the end of the strap 58 is passed through the ring 56 and once the desire length is obtained, the user presses together the loops and hooks sections 62 and 64 for securing the desired length of the adjustable strap 58. Once a such length is set, the user simply attaches the loop 60 to the hook 54 and no further adjustment is required for subsequent uses. If another user wears the pad 10, or if the size of the legs of the same user grows, the length of the strap 58 may be adjusted again by doing the same operation.

With references to FIGS. 2 and 3, the first and second rigid shin shields 16 and 24 comprise longitudinal apertures 28 and 30 for allowing passage of a strap 38. Moreover, these rigid shin shields 16 and 24 comprise overlapping surfaces 33 and 35 capable of preventing movement between the upper and lower portions 12 and 22 at a contacting area when the belt 32 is secured in place. More particularly, these overlapping surfaces 33 and 35 comprise respective contacting portions 34 and 36 made of rubber having a friction coefficient which is sufficient for preventing movement between the upper and lower portions 12 and 22 when the belt 32 is secured in place. As seen on FIG. 6, a contacting area C is defined when these contacting portions 34 and 36 are press together by the action of the belt 32.

Figures 6, 7, 8, 9, 10:
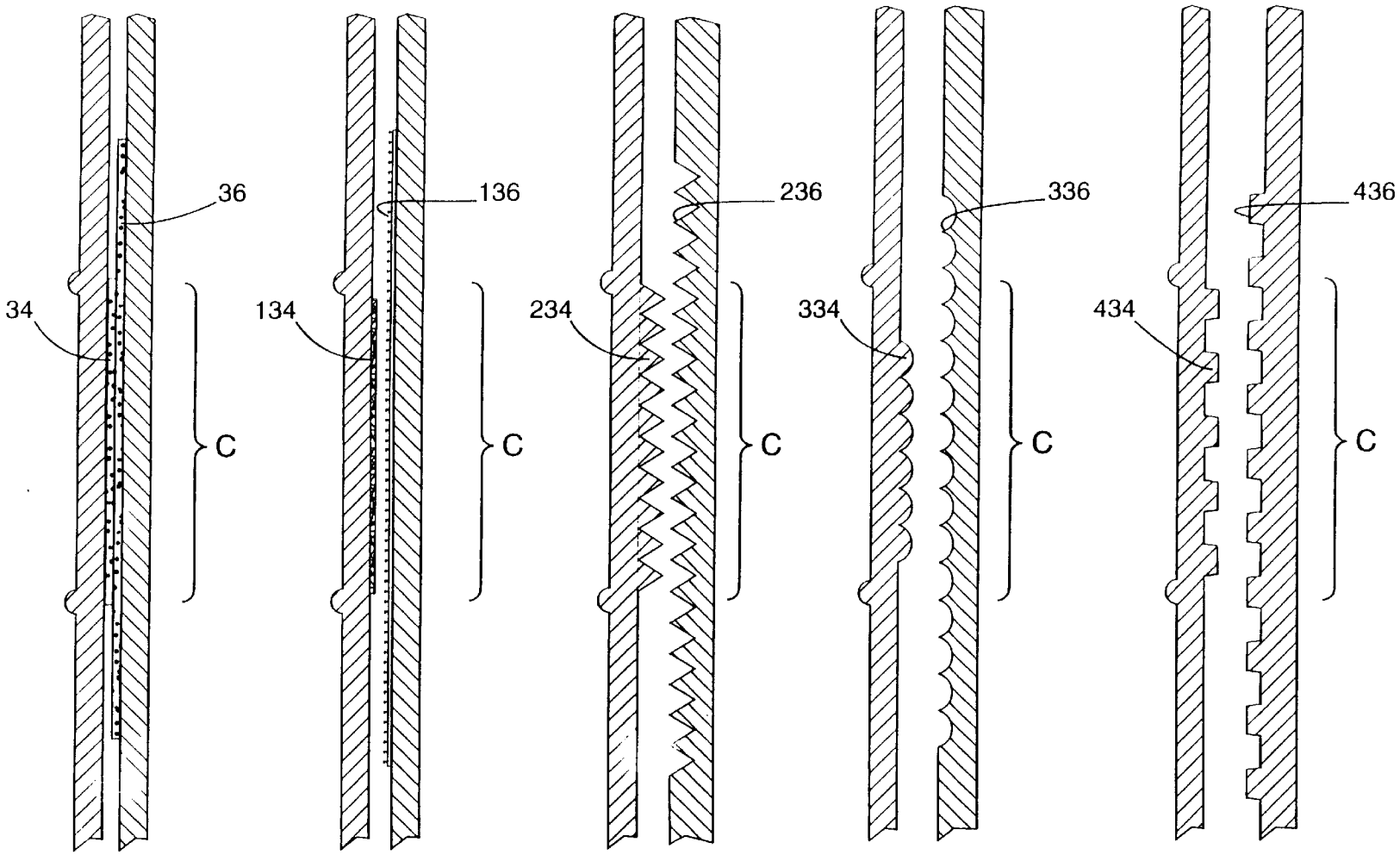
FIG. 6 is an enlarged partial side cross-sectional view showing contacting portions of the pad illustrated in FIG. 1.
FIG. 7 is an enlarged partial side cross-sectional view showing contacting portions constructed in accordance with a first variant.
FIG. 8 is an enlarged partial side cross-sectional view showing contacting portions constructed in accordance with a second variant.
FIG. 9 is an enlarged partial side cross-sectional view showing contacting portions constructed in accordance with a third variant.
FIG. 10 is an enlarged partial side cross-sectional view showing contacting portions constructed in accordance with a fourth variant.

FIG. 7 illustrates a variant wherein the overlapping surface 33 comprises a contacting portion 134 having a loops section and the overlapping surface 35 comprises a contacting portion 136 having a hooks section. Again, these contacting portions 134 and 136 are capable of preventing movement between the upper and lower portions 12 and 22 when the belt 32 is in place.

FIG. 8 illustrates a second variant wherein the overlapping surfaces 33 and 35 comprise respectively contacting portions 234 and 236 having toothed sections. The shape of the teeth may allow movement of the upper portion 12 relative to the lower portion 22 while also allowing mechanical engagement between these upper and lower portions 12 and 22, and preventing movement between these portions 12 and 22 when the belt 32 is in place. FIGS. 9 and 10 illustrate a third and fourth variant respectively. In FIG. 9, the shape of the teeth of contacting portions 334 and 336 may allow an easier movement of the upper and lower portions 12 and 22 relative to each other when adjusting the length of the pad 10. In FIG. 10, the shape of teeth of contacting portions 434 and 436 may allow a better mechanical engagement between the upper and lower portions 12 and 22. Again, these contacting portions 334 and 336, and 434 and 436, are capable of preventing movement between the upper and lower portions 12 and 22 when the belt 32 is in place.

Figure 11:
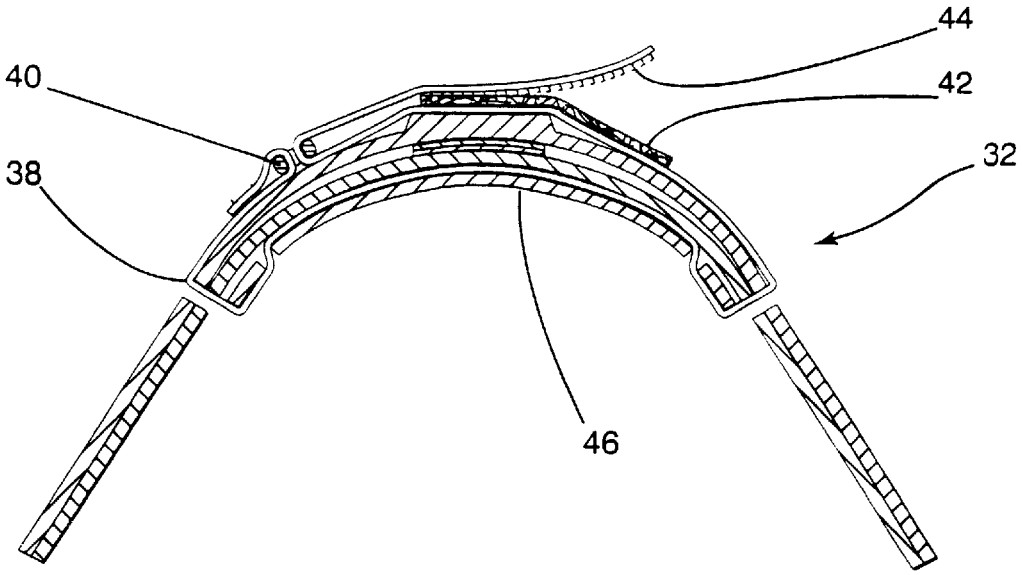
FIG. 11 is an enlarged sectional view taken along lines 11—11 of FIG. 1.
Figure 12:
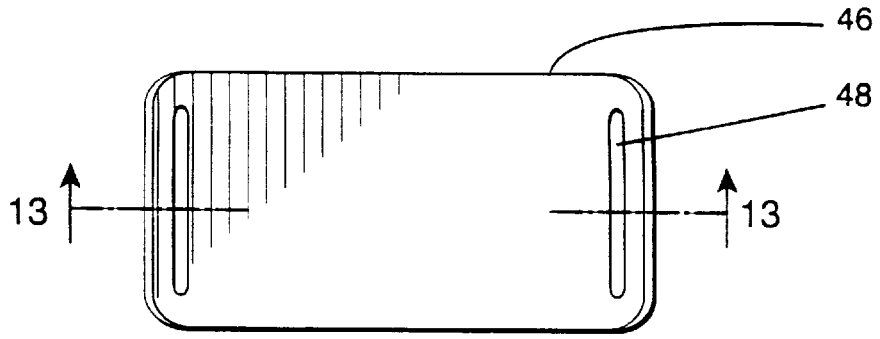
FIG. 12 is an enlarged rear view of a strap frame for the pad illustrated in FIG. 1.
Figure 13:
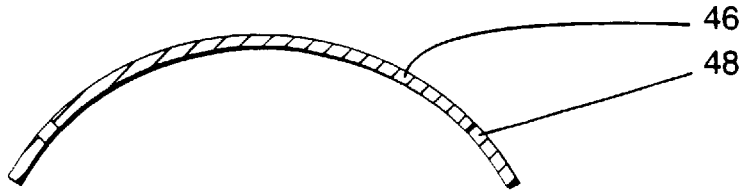
FIG. 13 is a sectional view taken along lines 13—13 of FIG. 12.

With references to FIGS. 11 to 13, the belt 32 comprises a strap 38 having at one extremity a ring 40, and at the other extremity, a loops section 42 which can be joined with a hooks section 44. The strap assembly 32 also comprises a strap frame 46 having two longitudinal apertures 48 allowing passage of the nylon strap 38. As seen on FIG. 13, the strap frame 46 has a curvature that substantially follows the curvature of the rigid shin shields 16 and 24.

In use, the user thus moves the upper portion 12 relative to the lower portion 22 until he has obtained the desirable length of the pad 10. Note that a length indicator 50 applied on the lower portion 22 will give to the user the length of the pad by reading through the hole 52. Once the desirable length is obtained, the user then pulls the extremity of the strap 38 and presses together the loops and hooks section 42 and 44. Hence, the upper and lower portions 12 and 22 are secured together since no movement is possible due to the joining action between the contacting portions of the overlapping surfaces 33 and 35 at the contacting area C.

It is understood that the knee, first and second shields may have a configuration, and may be made of a material which provides sufficient protection while also offering sufficient comfort in order to avoid use of padding liners. It is also understood that the first portion may only comprise a knee shield while the second portion may comprise a longer shin shield.

The above description of the preferred embodiment should not be interpreted in any limiting manner since variations and refinements are possible which are within the spirit and scope of the present invention. The scope of the invention is defined in the appended claims and their equivalents.

The embodiments of the invention for which an exclusive property or privilege is claimed are defined as follows:

1. An extensible leg pad including:

a) an upper portion comprising a knee shield for covering a substantial part of a front surface of a user's knee and a first shin shield along and partially around the user's shin, said upper portion further comprising front and rear faces;

b) a lower portion comprising front and rear faces and a second shin shield along and partially around the shin, said first and second shields having respective first and second overlapping surfaces;

c) said upper and lower portions being slidable one relative to the other to allow adjustment of the overall length of said pad; and d) a belt for securing together said upper and lower portions, said belt encircling said overlapping portions and engaging the rear face of one of said upper or lower portions, and said belt being responsive to tension for pressing said overlapping surfaces together and thereby preventing said upper and lower portions from sliding one relative to the other.

2. The extensible leg pad as defined in claim 1, wherein a portion of said first and second overlapping surfaces has a projection.

3. The extensible leg pad as defined in claim 2, wherein said projection comprises toothed sections.

4. The extensible leg pad as defined in claim 1, wherein a portion of one of said first and second overlapping surfaces portion is made of rubber.

5. The extensible pad as defined in claim 1, wherein a portion of said first and second overlapping surfaces has respective loops and hooks sections.

6. The extensible leg pad as defined in claim 1 or 2, wherein said first and second shin shields comprise longitudinal apertures allowing passage of said belt.

7. The extensible leg pad as defined in claim 1 or 2, wherein said pad further comprises a length indicator.

8. The extensible leg pad as defined in claim 1 or 2, wherein one of said portions has a longitudinal length which is longer than a longitudinal length of the other of said portions.

9. The extensible leg pad as defined in claim 1 or 2, wherein said overlapping surfaces allow a length adjustment of at least 2 inches.

10. The extensible leg pad as defined in claim 1 or 2, wherein said knee and said first and second shin shields are made of plastic.

11. The extensible leg pad as defined in claim 1 or 2, wherein said knee shield and said first shin shield are secured to an upper padding liner positionable over the knee and along and partially around the shin.

12. The extensible leg pad as defined in claim 1 or 2, wherein said second shin shield is secured to a lower padding line positionable along and partially around the shin.

13. The extensible leg pad as defined in claim 1 or 2, wherein said pad further comprises at least one strap assembly having a hook secured on one side of said pad, a ring secured on the other side of said pad, and an adjustable strap having a loop at one end and loops and hooks sections wherein said loop engages with said hook.

14. The extensible leg pad as defined in claim 1 or 2, wherein said belt comprises a strap and a strap frame having a curvature and two longitudinal apertures allowing passage of said strap.

15. An extensible leg pad including:

a) an upper portion comprising a knee shield for covering a substantial part of a front surface of a user's knee and a first shin shield along and partially around the user's shin;

b) a lower portion comprising a second shin shield along and partially around the shin, said first and second shields having respective first and second overlapping surfaces;

c) said upper and lower portions being slidable one relative to the other to allow adjustment of the overall length of said pad; and d) a belt for securing together said upper and lower portions, said belt being responsive to tension for pressing said overlapping surfaces at a contacting area, and said belt comprising a strap and a strap frame having a curvature and two longitudinal apertures allowing passage of said strap.

16. The extensible leg pad as defined in claim 15, wherein a portion of said first and second overlapping surfaces has a projection.

17. The extensible pad as defined in claim 16, wherein said projection comprises toothed sections.

18. The extensible pad as defined in claim 15, wherein a portion of one of said first and second overlapping surfaces is made of rubber.

19. The extensible leg pad as defined in claim 15, wherein a portion of said first and second overlapping surfaces has respective loops and hooks sections.

20. The extensible leg pad as defined in claim 15, wherein said strap comprises loops and hooks sections.

21. The extensible leg pad as defined in claim 15, wherein said first and second shin shields comprise longitudinal apertures allowing passage of said belt.

22. The extensible leg pad as defined in claim 15, wherein said pad further comprises a length indicator.

23. The extensible leg pad as defined in claim 15, wherein one of said portions has a longitudinal length which is longer than a longitudinal length of the other of said portions.

24. The extensible leg pad as defined in claim 15, wherein said overlapping surfaces allow a length adjustment of at least 2 inches.

25. The extensible leg pad as defined in claim 15, wherein said knee and said first and second shin shields are made of plastic.

26. The extensible leg pad as defined in claim 15, wherein said knee shield and said first shin shield are secured to an upper padding liner positionable over the knee and along and partially around the shin.

27. The extensible leg pad as defined in claim 15, wherein said second shin shield is secured to a lower padding line positionable along and partially around the shin.

28. The extensible leg pad as defined in claim 15, wherein said pad further comprises at least one strap assembly having a hook secured on one side of said pad, a ring secured on the other side of said pad, and an adjustable strap having a loop at one end and loops and hooks sections wherein said loop engages with said hook.

29. An extensible leg pad including:

a) an upper portion comprising a knee shield for covering a substantial part of a front surface of a user's knee and a first shin shield along and partially around the user's shin;

b) a lower portion comprising a second shin shield along and partially around the shin, said first and second shields having respective first and second overlapping surfaces;

c) said upper and lower portions being slidable one relative to the other to allow adjustment of the overall length of said pad;

d) at least one strap assembly having a hook secured on one side of said pad, a ring secured on the other side of said pad, and an adjustable strap having a loop at one end and loops and hooks sections wherein said loop engages with said hook; and e) a belt for securing together said upper and lower portions, said belt being responsive to tension for pressing said overlapping surfaces at a contacting area.

30. The extensible leg pad as defined in claim 29, wherein a portion of said first and second overlapping surfaces has a projection capable of interlocking said portions together.

31. The extensible pad as defined in claim 30, wherein said projection comprises toothed sections.

32. The extensible pad as defined in claim 29, wherein a portion of one of said first and second overlapping surfaces is made of rubber.

33. The extensible leg pad as defined in claim 29, wherein a portion of said first and second overlapping surfaces has respective loops and hooks sections.

34. The extensible leg pad as defined in claim 29, wherein said first and second shin shields comprise longitudinal apertures allowing passage of said belt.

35. The extensible leg pad as defined in claim 29, wherein said pad further comprises a length indicator.

36. The extensible leg pad as defined in claim 29, wherein one of said portions has a longitudinal length which is longer than a longitudinal length of the other of said portions.

37. The extensible leg pad as defined in claim 29, wherein said overlapping surfaces allow a length adjustment of at least 2 inches.

38. The extensible leg pad as defined in claim 29, wherein said knee and said first and second shin shields are made of plastic.

39. The extensible leg pad as defined in claim 29, wherein said knee shield and said first shin shield are secured to an upper padding liner positionable over the knee and along and partially around the shin.

40. The extensible leg pad as defined in claim 29, wherein said second shin shield is secured to a lower padding line positionable along and partially around the shin.

41. The extensible leg pad as defined in claim 29, wherein said belt comprises a strap and a strap frame having a curvature and two longitudinal apertures allowing passage of said strap.

42. An extensible leg pad including:

a) an upper portion comprising front and rear faces and a knee shield for covering a substantial part of a front surface of a user's knee;

b) a lower portion comprising front and rear faces and a shin shield along and partially around the user's shin, said knee and shin shields comprising respective first and second overlapping surfaces;

c) said upper and lower portions being slidable one relative to the other to allow adjustment of the overall length of said pad; and d) a belt for securing together said upper and lower portions, said belt encircling said overlapping portions and engaging the rear face of one of said upper or lower portions, and said belt being responsive to tension for pressing said overlapping surfaces together and thereby preventing said upper and lower portions from sliding one relative to the other.

43. The extensible leg pad as defined in claim 42, wherein a portion of said first and second overlapping surfaces has a projection.

44. The extensible leg pad as defined in claim 43, wherein said projection comprises toothed sections.

45. The extensible leg pad as defined in claim 42, wherein a portion of one of said first and second overlapping surfaces portion is made of rubber.

46. The extensible pad as defined in claim 42, wherein a portion of said first and second overlapping surfaces has respective loops and hooks sections.

47. The extensible leg pad as defined in claim 42 or 43, wherein said knee and shin shields comprise longitudinal apertures allowing passage of said belt.

48. The extensible leg pad as defined in claim 42 or 43, wherein said pad further comprises a length indicator.

49. The extensible leg pad as defined in claim 42 or 43, wherein one of said portions has a longitudinal length which is longer than a longitudinal length of the other of said portions.

50. The extensible leg pad as defined in claim 42 or 43, wherein said overlapping surfaces allow a length adjustment of at least 2 inches.

51. The extensible leg pad as defined in claim 42 or 43, wherein said knee and shin shields are made of plastic.

52. The extensible leg pad as defined in claim 42 or 43, wherein said knee shield is secured to an upper padding liner positionable over the knee and along and partially around the shin.

53. The extensible leg pad as defined in claim 42 or 43, wherein said shin shield is secured to a lower padding line positionable along and partially around the shin.

54. The extensible leg pad as defined in claim 42 or 43, wherein said pad further comprises at least one strap assembly having a hook secured on one side of said pad, a ring secured on the other side of said pad, and an adjustable strap having a loop at one end and loops and hooks sections wherein said loop engages with said hook.

55. The extensible leg pad as defined in claim 42 or 43, wherein said belt comprises a strap and a strap frame having a curvature and two longitudinal apertures allowing passage of said strap.

56. An extensible leg pad including:

a) an upper portion comprising a knee shield for covering a substantial part of a front surface of a user's knee;

b) a lower portion comprising a shin shield along and partially around a user's shin, said knee and shin shields comprising respective first and second overlapping surfaces;

c) said upper and lower portions being slidable one relative to the other to allow adjustment of the overall length of said pad;

d) a belt for securing together said upper and lower portions, said belt being responsive to tension for pressing said overlapping surfaces together at a contacting area, and said belt comprising a strap and a strap frame having a curvature and two longitudinal apertures allowing passage of said strap.

57. An extensible leg pad including:

a) an upper portion comprising a knee shield for covering a substantial part of a front surface of a user's knee;

b) a lower portion comprising a shin shield along and partially around a user's shin, said knee and shin shields comprising respective first and second overlapping surfaces;

c) said upper and lower portions being slidable one relative to the other to allow adjustment of the overall length of said pad;

d) at least one strap assembly having a hook secured on one side of said pad, a ring secured on the other side of said pad, and an adjustable strap having a loop at one end and loops and hooks sections wherein said loop engages with said hook; and e) a belt for securing together said upper and lower portions, said belt being responsive to tension for pressing said overlapping surfaces together at a contacting area.

58. A leg pad including an upper portion comprising a knee shield for covering a substantial part of a front surface of a user's knee and a first shin shield along and partially around the user's shin, said knee shield and said first shin shield being secured to an upper padding liner positionable over the knee and along and partially around the shin, a lower portion comprising a second shin shield along and partially around the shin which is secured to a lower padding liner positionable along and partially around the shin, and at least one strap assembly having a hook secured on one side of said pad, a ring secured on the other side of said pad, and an adjustable strap having a loop at one end and loops and hooks sections wherein said loop engages with said hook.

* * * * *